US008044799B2

(12) United States Patent
Chae et al.

(10) Patent No.: US 8,044,799 B2
(45) Date of Patent: Oct. 25, 2011

(54) APPARATUS AND METHOD FOR PREVENTING LOSS OF PORTABLE TERMINAL

(75) Inventors: Kyoung Soo Chae, Gyunggi-do (KR); Ghun Hahm, Seoul (KR); Hyun Joon Kim, Gyunggi-do (KR)

(73) Assignee: Samsung Electro-Mechanics Co., Ltd., Gyunggi-do (KR)

( * ) Notice: Subject to any disclaimer, the term of this patent is extended or adjusted under 35 U.S.C. 154(b) by 649 days.

(21) Appl. No.: 11/844,726

(22) Filed: Aug. 24, 2007

(65) Prior Publication Data

US 2008/0048875 A1 Feb. 28, 2008

(30) Foreign Application Priority Data

Aug. 25, 2006 (KR) ..... 10-2006-0081252

(51) Int. Cl.
*G08B 21/00* (2006.01)

(52) U.S. Cl. ..... 340/571; 340/568.1; 340/568.6; 340/568.7; 455/344

(58) Field of Classification Search ..... 340/568.7, 340/568.6, 569, 570, 571, 568.1; 455/344
See application file for complete search history.

(56) References Cited

U.S. PATENT DOCUMENTS

| | | | | |
|---|---|---|---|---|
| 4,460,892 | A * | 7/1984 | Bailey, Jr. | 340/555 |
| 5,635,897 | A * | 6/1997 | Kuo | 340/7.58 |
| 6,570,504 | B2 * | 5/2003 | Rabanne et al. | 340/573.4 |
| 6,759,958 | B2 * | 7/2004 | Hall | 340/568.1 |
| 2003/0001738 | A1 * | 1/2003 | Chandar | 340/568.1 |

* cited by examiner

*Primary Examiner* — Jennifer Mehmood
*Assistant Examiner* — Mark Rushing
(74) *Attorney, Agent, or Firm* — Lowe, Hauptman, Ham & Berner, LLP

(57) ABSTRACT

There is provided an apparatus and a method for preventing a loss of a portable terminal, the apparatus including: a luminous intensity sensor unit detecting a current luminous intensity; a main controller unit controlling to request for an input of a password and controlling to output a warning sound when a current luminous intensity is higher than a reference luminous intensity; a display unit outputting a screen for requesting for the password and other screens related to a process of loss prevention; a key input unit via which keys related to the process of loss prevention are inputted; a memory unit in which the current luminous intensity detected by the luminous intensity sensor unit and the reference luminous intensity are saved; and a warning device generating and outputting the warning sound in accordance with the controlling of the main controller unit.

9 Claims, 4 Drawing Sheets

APPARATUS AND METHOD FOR PREVENTING LOSS OF PORTABLE TERMINAL

CLAIM OF PRIORITY

This application claims the benefit of Korean Patent Application No. 2006-0081252 filed on Aug. 25, 2006, in the Korean Intellectual Property Office, the disclosure of which is incorporated herein by reference.

BACKGROUND OF THE INVENTION

1. Field of the Invention

The present invention relates to an apparatus for preventing the loss of a portable terminal such as a mobile phone, and more particularly, to an apparatus for preventing the loss of a portable terminal by outputting a warning sound notifying the loss of the portable terminal in accordance with a luminous intensity, which is a degree of exposure to light, before the actual loss occurs, thereby preventing the loss in advance, and to a method of preventing the loss of a portable terminal.

2. Description of the Related Art

Recently, with miniaturization of electronic devices and development in communication technology, the penetration rate of portable devices such as electronic dictionaries, mobile phones, and the like has been rapidly increasing. In addition, the portable devices have become more convenient in terms of portability.

Despite the convenience of portability, often times, user may lose a portable device, for example, when it accidentally slips out of his or her pocket, and so on.

To this end, a conventional apparatus for preventing the loss of a portable terminal according to the prior art will be described with reference to FIG. 1.

FIG. 1 is a configuration view illustrating the conventional apparatus for preventing the loss of a portable terminal.

The conventional apparatus for preventing the loss of a portable terminal shown in FIG. 1 includes a transmitter unit 21, a receiver unit 22, and an output unit 23. The transmitter unit 21 generates and transmits a predetermined magnitude of magnetic force. The receiver unit 22 measures a magnetic change of the magnetic force in accordance with a distance to the transmitter unit 21, and outputs a warning control signal CTL when the magnetic change is greater than a reference signal. The output unit 23 outputs a warning signal OUT-S in response to the warning control signal CTL.

The above-described construction is disclosed in Korea Patent Application Publication No. 2006-0029561.

However, the conventional apparatus for preventing the loss of a portable terminal utilizes magnetic force, which may cause malfunction in an environment with large surrounding magnetic changes such as in taxi, subway and structures of metal frames.

SUMMARY OF THE INVENTION

An aspect of the present invention provides an apparatus outputting a warning sound notifying the loss of a portable terminal in accordance with a luminous intensity, which is a degree of exposure to light, before the actual loss occurs, thereby preventing the loss in advance, and to a method of preventing the loss of a portable terminal.

According to an aspect of the invention, there is provided an apparatus for preventing a loss of a portable terminal, the apparatus including: a luminous intensity sensor unit detecting a current luminous intensity; a main controller unit controlling to request for an input of a password and controlling to output a warning sound when the current luminous intensity is higher than a reference luminous intensity and controlling to stop the output of the warning sound when the password inputted matches a predetermined password; a display unit outputting a screen for requesting for the password and other screens related to a process of loss prevention according to the controlling of the main controller unit; a key input unit via which the password and keys related to the process of loss prevention are inputted in accordance with the request from the main controller unit; a memory unit in which the current luminous intensity detected by the luminous intensity sensor unit and the reference luminous intensity are saved; and a warning device generating and outputting the warning sound in accordance with the controlling of the main controller unit.

The main controller unit may set the current luminous intensity, detected by the luminous intensity sensor unit immediately after the process of loss prevention begins, as the reference luminous intensity and save the reference luminous intensity in the memory unit.

The main controller unit may substitute the reference luminous intensity with the current luminous intensity, when the current luminous intensity detected by the luminous intensity sensor unit is lower than the reference luminous intensity after the process of loss prevention begins.

The luminous intensity sensor unit may include: a luminous intensity sensor detecting a current luminous intensity; and a sub-controller monitoring the current luminous intensity detected by the luminous intensity sensor and determining whether or not the current luminous intensity is higher than the reference luminous intensity and transmitting a result of comparison to the main controller unit.

The sub-controller may set the luminous intensity, detected by the luminous intensity sensor immediately after the process of loss prevention begins, as the reference luminous intensity and save the reference luminous intensity in the memory unit.

The sub-controller may substitute the reference luminous intensity with the current luminous intensity when the current luminous intensity detected by the luminous intensity sensor is lower than the reference luminous intensity after the process of loss prevention begins.

According to an aspect of the invention, there is provided a method of preventing loss of a portable terminal, the method including: detecting a current luminous intensity when a process of loss prevention begins and setting the detected current luminous intensity as a reference luminous intensity; repeatedly detecting a current luminous intensity throughout the process of loss prevention; comparing the current luminous intensity with the reference luminous intensity and substituting the reference luminous intensity with the current luminous intensity when the current luminous intensity is lower than the reference luminous intensity; generating and outputting a warning sound when the current luminous intensity is higher than the reference luminous intensity; requesting for an input of a password and determining whether the password inputted matches a predetermined password; and stopping an output of the warning sound when the password inputted matches the predetermined password.

The generating and outputting a warning sound may include: determining whether the portable terminal is in a calling state or not when the current luminous intensity is higher than the reference luminous intensity; and generating and outputting the warning sound when the portable terminal is not in a calling state.

The method may further include returning to detecting a current luminous intensity when termination is not selected after the stopping an output of the warning sound or when termination is not selected after the portable terminal is determined to be in a calling state in the generating and outputting a warning sound.

BRIEF DESCRIPTION OF THE DRAWINGS

The above and other aspects, features and other advantages of the present invention will be more clearly understood from the following detailed description taken in conjunction with the accompanying drawings, in which.

DETAILED DESCRIPTION OF THE PREFERRED EMBODIMENT

Figure 1:
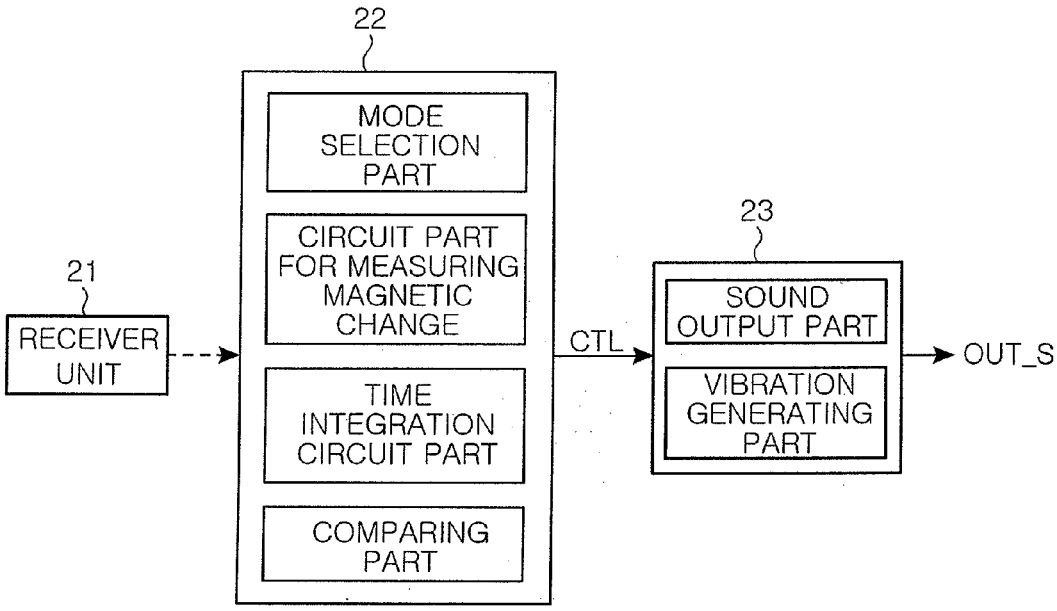
FIG. 1 is a configuration view illustrating a conventional apparatus for preventing the loss of a portable terminal.

Exemplary embodiments of the present invention will now be described in detail with reference to the accompanying drawings. The invention may however be embodied in many different forms and should not be construed as limited to the embodiments set forth herein. Rather, these embodiments are provided to assist understanding of the technical ideas of the invention. In the drawings, the same reference numerals are used throughout to designate the same or similar components.

Figure 2:
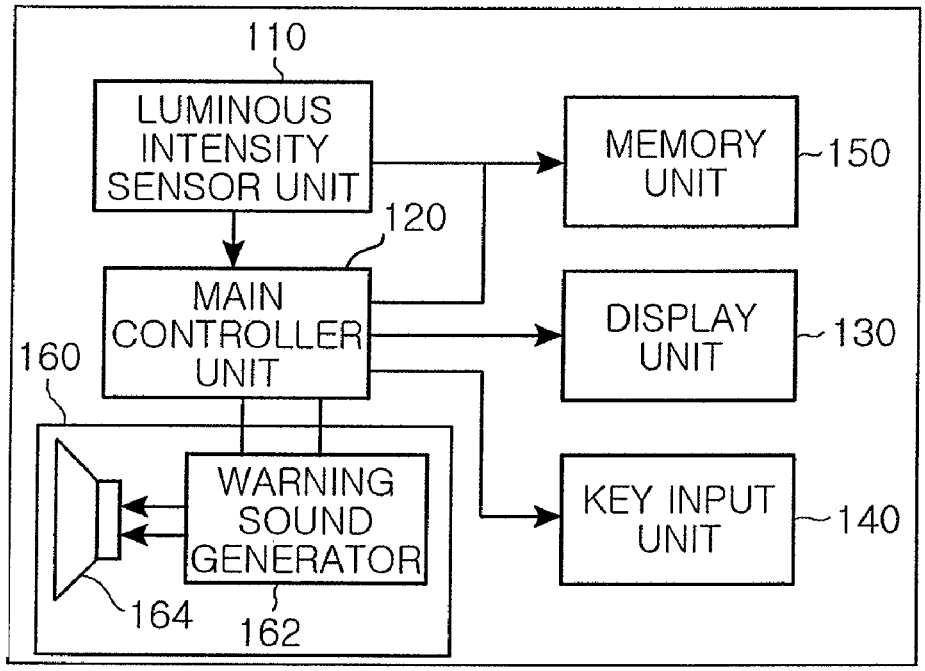
FIG. 2 is a configuration view illustrating an apparatus for preventing the loss of a portable terminal according to an exemplary embodiment of the present invention.

FIG. 2 is a configuration view illustrating an apparatus for preventing the loss of a portable terminal according to an exemplary embodiment of the present invention.

Referring to FIG. 2, the apparatus for preventing the loss of a portable terminal includes a current luminous intensity sensor unit 110 detecting a current luminous intensity; a main controller unit 120 controlling to request for an input of a password, controlling to output a warning sound, and controlling to stop the warning sound when the inputted password matches a predetermined password; a display unit 130 via which a screen for requesting the password and other screens related to a process of loss prevention are inputted in accordance with the controlling of the main controller 120; a key input unit 140 via which the password and keys related to the process of loss prevention are inputted in accordance with the request from the main controller 120; a memory unit 150 in which a current luminous intensity detected by the luminous sensor unit 110 and a reference luminous intensity are saved; and a warning device 160 generating and outputting the warning sound according to the controlling of the main controller 120.

In addition, the main controller 120 may set the current luminous intensity detected by the luminous intensity sensor unit 110 immediately after the process of loss prevention begins, as the reference luminous intensity, and save the reference luminous intensity in the memory unit 150, and substitute the reference luminous intensity with the current luminous intensity when the current luminous intensity detected by the luminous intensity sensor unit 110 is lower than the reference luminous intensity.

On the other hand, since the main controller 120 is in charge of the entire control of the portable terminal, the luminous intensity sensor unit 110 may perform setting the reference luminous intensity and comparing the luminous intensities, in order to reduce a workload of the main controller unit 120.

Figure 3:
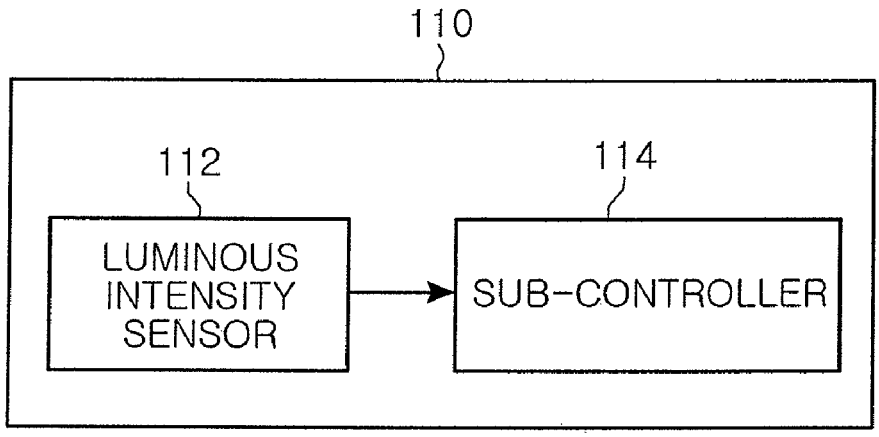
FIG. 3 is a configuration view illustrating in detail a luminous intensity sensor unit of FIG. 2 according to an exemplary embodiment of the present invention.

FIG. 3 is a configuration view illustrating a construction of the luminous intensity sensor unit of FIG. 2 according to an exemplary embodiment of the present invention.

Referring to FIG. 3, the luminous intensity sensor unit 110 includes a luminous intensity sensor 112 detecting a current luminous intensity; and a sub-controller 114 monitoring the current luminous intensity from the luminous intensity sensor 112 to determine whether the current luminous intensity detected by the luminous intensity sensor 112 is higher than the reference luminous intensity and transmitting a result of comparison to the main controller 120.

In this case, the sub-controller 114 may set the luminous intensity, detected by the luminous intensity sensor 112 immediately after the process of loss prevention begins, as the reference luminous intensity and save the reference luminous intensity in the memory unit 150, and substitute the reference luminous intensity with the current luminous intensity, when the current luminous intensity detected by the luminous intensity sensor 112 is lower than the reference luminous intensity after the process of loss prevention begins.

Figure 4:
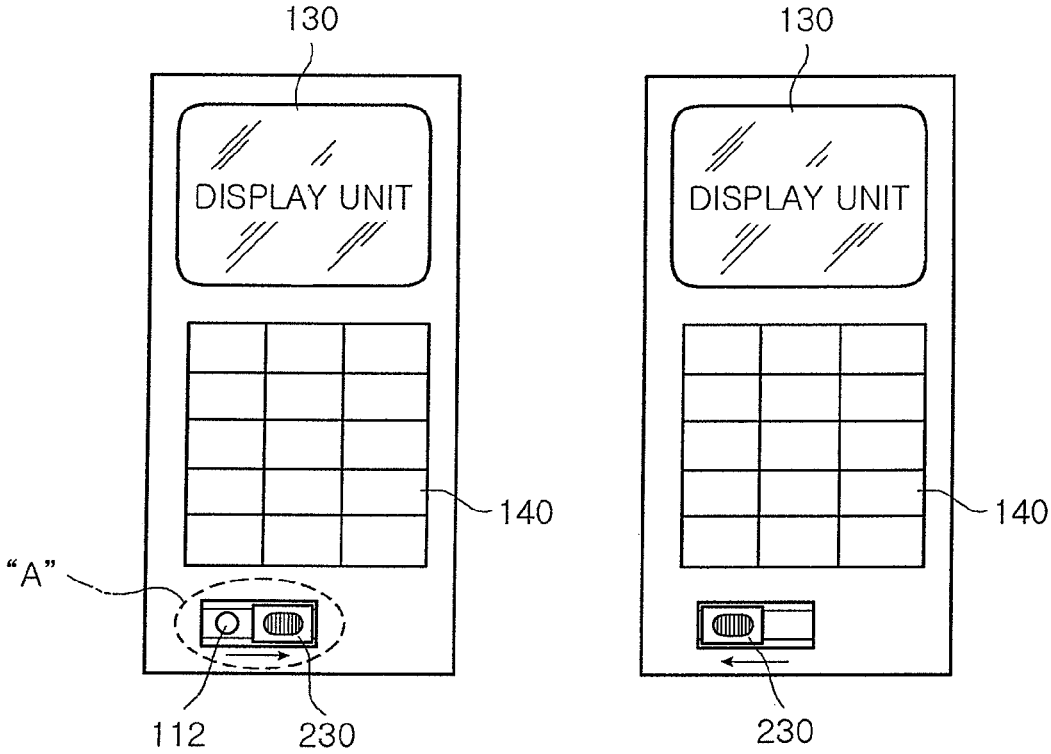
FIG. 4 is a view illustrating a door sliding to expose or cover a luminous intensity sensor according to an exemplary embodiment of the present invention.

FIG. 4 is an exemplary view of a door sliding to expose and cover the luminous intensity sensor 112.

Referring to FIG. 4, the door 230 may be installed in an exterior of the portable terminal to expose the luminous intensity sensor 112 to an external environment or to separate the luminous intensity sensor 112 from the external environment.

Figure 5:
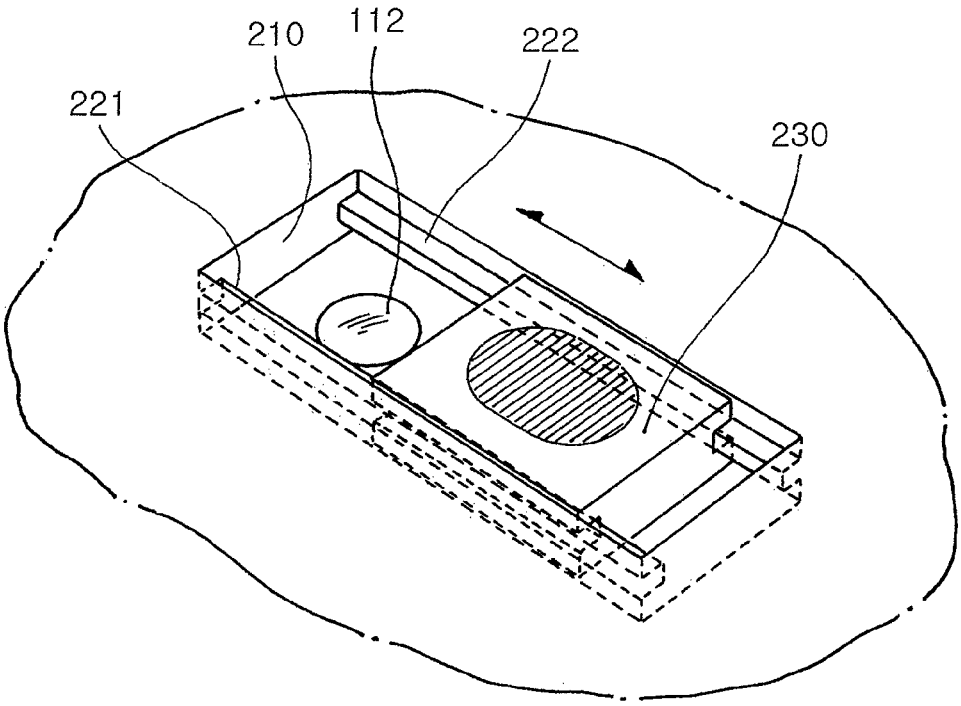
FIG. 5 is an enlarged view illustrating part A of FIG. 4.

FIG. 5 is an enlarged exemplary view of part A of FIG. 4.

Referring to FIG. 5, the luminous intensity sensor 1120 is installed at a location in a recessed portion 210 formed in the exterior of the portable terminal.

In this case, the luminous intensity sensor 112 may be exposed and covered by the door 230 sliding on guides 221 and 222 formed in parallel on opposing sides of the recessed portion 210.

Figure 6:
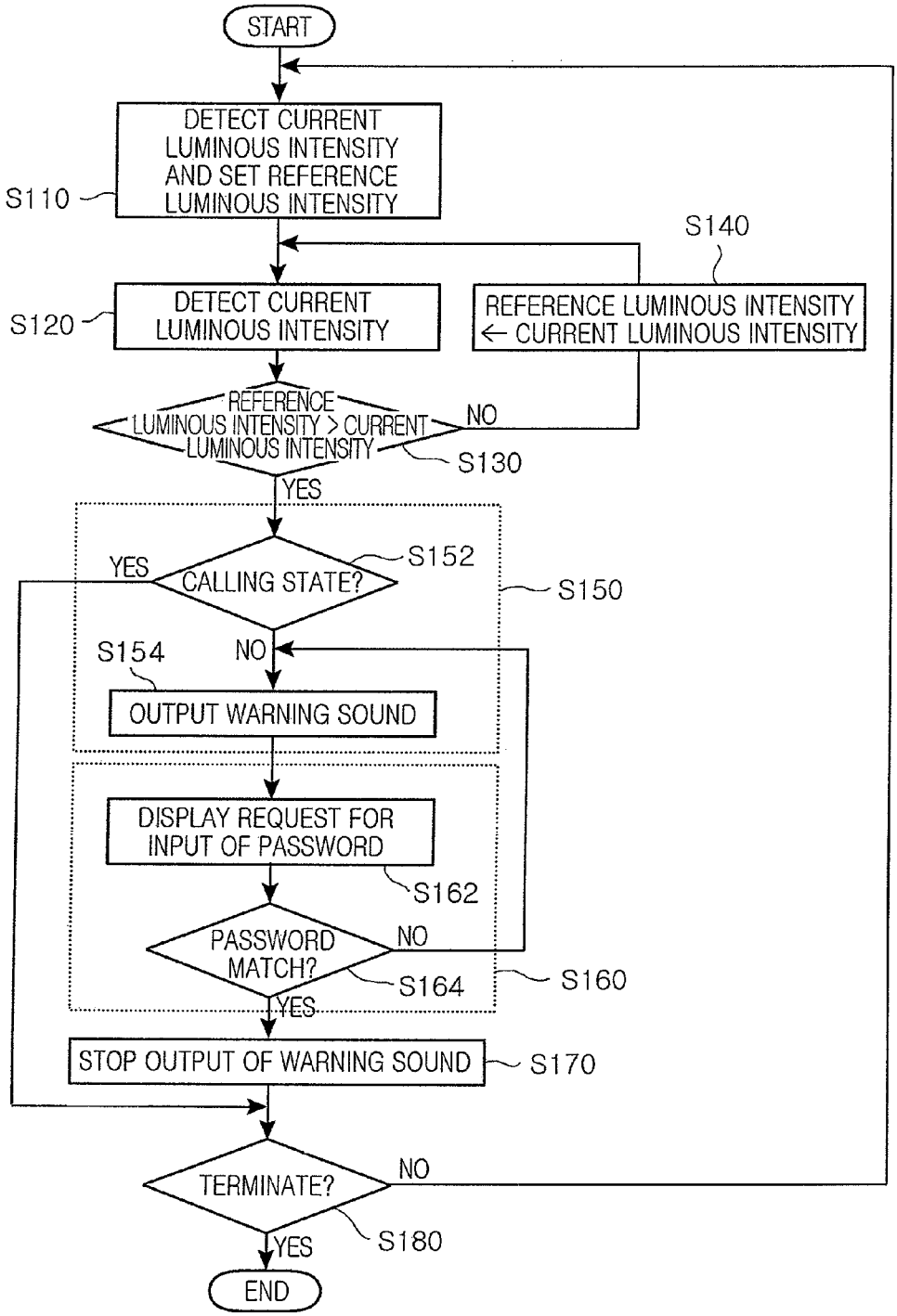
FIG. 6 is a flowchart showing a method of preventing the loss of a portable terminal according to an exemplary embodiment of the present invention.

FIG. 6 is a flowchart showing a method of preventing the loss of a portable terminal according to an exemplary embodiment of the present invention.

In FIG. 6, S110 denotes an operation of setting a reference luminous intensity, S120 denotes an operation of detecting a current luminous intensity, S130 and S140 denote an operation of resetting the reference luminous intensity, S150 denotes an operation of activating a warning, S160 denotes an operation of determining a match of a password, and S170 denotes an operation of deactivating the warning.

Hereinafter, the workings and effects of the present invention will be described in detail with reference to accompanying drawings.

With reference to FIGS. 2 to 5, first, in the apparatus for preventing the loss of a portable terminal shown in FIG. 2, when the process of loss prevention begins, the luminous sensor unit 110 detects a current luminous intensity.

In this case, the process of loss prevention may be begun and terminated via the key input part 140, and may also be automatically terminated when the portable terminal is in a calling state.

Two exemplary configurations of the luminous sensor unit 110 are described. In a first exemplary configuration, the luminous intensity sensor unit 110 detects a current luminous intensity and transmits the detected current luminous intensity directly to the main controller unit 120. In this case, the main controller unit 120 may perform setting a reference luminous intensity based on the current luminous intensity detected by the luminous intensity sensor unit 110 and comparing the luminous intensities.

In a second exemplary configuration, the luminous intensity sensor unit 110 detects a current luminous intensity, and based on this detected current luminous intensity, may perform setting the reference luminous intensity and comparing the luminous intensities. In the second exemplary configuration, a workload of the main controller unit 120 is reduced, which will be described later with reference to FIG. 3.

Referring to FIG. 2, the first exemplary configuration of the luminous intensity sensor unit 110 will be described.

In this case, the main controller 120 controls the display unit 130 to output a screen for requesting for an input of a password and the warning device 160 to output a warning sound when the current luminous intensity detected by the luminous intensity sensor unit 110 is higher than the reference luminous intensity.

Then, the main controller unit 120 may set the current luminous intensity, detected by the luminous intensity sensor unit 110, as the reference luminous intensity and save the reference luminous intensity in the memory unit 150, and substitute the reference luminous intensity with the current luminous intensity when the current luminous intensity detected by the luminous intensity sensor unit 110 is lower than the reference luminous intensity, thereby resetting the reference luminous intensity.

Referring to FIGS. 2 and 3, the second exemplary configuration of the luminous intensity sensor unit 110 will be described.

In this case, the luminous intensity sensor unit 110 may include the luminous intensity sensor 112 and the sub-controller 114. The luminous intensity sensor 112 detects a current luminous intensity in the surrounding environment and outputs the detected current luminous intensity to the sub-controller 114. The sub-controller 114 monitors the current luminous intensity from the luminous intensity sensor 112 and determines whether the current luminous intensity is higher than the reference luminous intensity and transmits a result of comparison to the main controller unit 120.

When the current luminous intensity is higher than the reference luminous intensity, the main controller unit 120 controls the display unit 130 to output a screen for requesting for an input of a password, and at the same time, controls the warning device 160 to output a warning sound.

In this case, the sub-controller 114 may set the current luminous intensity, detected by the luminous intensity sensor 112 immediately after the process of the loss prevention begins, and save the reference luminous intensity in the memory unit 150, and substitute the reference luminous intensity with the current luminous intensity when the current luminous intensity detected by the luminous intensity sensor 112 is lower than the reference luminous intensity after the process of loss prevention begins, thereby resetting the reference luminous intensity.

Then, the display unit 130 outputs a screen for requesting for the password, and at the same time, the warning device 160 generates and outputs the warning sound.

Describing the warning device 160 in detail, in a case where the warning device 160 includes a warning sound generator 162 and a speaker 164, the warning sound generator 162 generates the warning sound in accordance with the controlling to output of the warning sound by the main controller unit and outputs the warning sound via the speaker 164.

When the warning sound is being outputted as described above, the user will try to turn off the warning sound and the input of the password is required to turn the warning sound off.

At this time, the user sees the screen, for requesting the password, outputted by the display unit 130, and inputs the password via the key input unit 140. In this case, the controller 120 may control to stop the output of the warning sound when the password inputted via the key input unit 140 matches a predetermined password. Then, the warning device 160 stops the output of the warning sound.

In the meantime, while the apparatus for preventing the loss of a portable terminal is turned on, the user may directly select a stop of an operation mode of the apparatus via the key input unit 140, substantially turning off the apparatus. Alternatively, the user may indirectly stop the operation mode by isolating the luminous intensity sensor 112 from the external environment and disenabling the luminous intensity sensor 112 from detecting a luminous intensity change in the external environment.

Hereinafter, a process of indirectly stopping the operation mode by isolating the luminous intensity sensor 112 from the external environment will be described with reference to FIGS. 4 and 5.

First, referring to FIG. 4, while the luminous intensity sensor 112 is exposed to the external environment, it performs the above-described process of loss prevention by detecting the external luminous intensity.

However, when the user desires to discontinue the process of loss prevention of the apparatus, he or she may directly stop the operation mode via the key input unit 140.

Alternatively, referring to FIGS. 4 and 5, the user may indirectly stop the operation mode by disenabling the luminous intensity sensor 230 from detecting the external luminous intensity by sliding the door 230 to cover the luminous intensity sensor 112 detecting the luminous intensity in the recessed portion 210.

For example, with reference to FIGS. 4 and 5, by sliding the door 230 along the guides 221 and 222 of the recessed portion 210 of the portable terminal, the luminous intensity sensor 112 may be isolated from the external environment or exposed to the external environment.

As described above, when the apparatus for preventing the loss of a portable terminal is operating, the user may use the door 230 to indirectly stop the operation of the luminous intensity sensor, thereby manually conveniently discontinuing the process of loss prevention according to the present invention.

Hereinafter, the method of preventing the loss of a portable terminal will be described.

Referring to FIG. 6, first, in the operation of setting a reference luminous intensity, S110, when the process of loss prevention begins, a current luminous intensity is detected and set as the reference luminous intensity.

For example, with reference to FIGS. 2 to 4, when the apparatus for preventing the loss of a portable terminal starts operating, the luminous intensity sensor unit 110 detects a current luminous intensity and transmits the detected current luminous intensity to the main controller 120, and then the main controller 120 may set the detected current luminous intensity as the reference luminous intensity.

Referring to FIG. 6, in the operation of detecting a current luminous intensity, S120, the current luminous intensity is repeatedly detected throughout the process of loss prevention. For example, referring to FIGS. 2 to 4, the luminous intensity sensor unit 110 repeatedly detects the current luminous intensity and continuously transmits the detected current luminous intensity to the main controller unit 120.

Referring to FIG. 5 and FIG. 6, in the operation of resetting the reference luminous intensity, S130 and S140, the current luminous intensity and the reference luminous intensity are compared and when the current luminous intensity is lower than the reference luminous intensity, the reference luminous intensity is substituted with the current luminous intensity.

For example, with reference to FIGS. 2 to 4, the current luminous intensity detected by the luminous intensity sensor unit 110 and the reference luminous intensity saved in the memory unit 150 are compared and when the current luminous intensity is lower than the reference luminous intensity, the reference luminous intensity is substituted with the current luminous intensity and saved in the memory unit 150, thereby resetting the reference luminous intensity.

Referring to FIG. 6, in the operation of activating a warning S150, a warning sound is outputted when the current luminous intensity is higher than the reference luminous intensity.

For example, with reference to FIGS. 2 to 4, the main controller unit 120 controls to generate the warning sound via the warning device 160 when the current luminous intensity is higher than the reference luminous intensity, and accordingly, the warning device 160 generates and outputs the warning sound.

In detail, first, the main controller unit 120 determines whether the portable terminal is in a calling state or not when the current luminous intensity is higher than the reference luminous intensity, S152, and generates and outputs the warning sound when the portable terminal is not in a calling state, S154. But when the portable terminal is in a calling state, the main controller unit does not control to generate the warning sound.

Referring to FIG. 5, in the operation of determining a match of the password, S160, the main controller unit controls to request for an input of the password and determines whether or not the password inputted matches a predetermined password.

For example, referring to FIGS. 2 to 4, the main controller unit 120 displays a screen for requesting the password via the display unit 130. At this time, the user sees the screen for requesting the password, displayed by the display unit 130, and inputs the password via the key input unit 140.

Then, the main controller unit 120 determines whether the password inputted via the key input unit 140 matches a predetermined password saved in the memory unit 150.

Referring to FIG. 6, in the operation of deactivating the warning, S170, when the password inputted matches the predetermined password, the output of the warning sound is stopped.

For example, with reference to FIGS. 2 to 4, when the password inputted matches the predetermined password, the main controller unit 120 controls the warning device 160 to stop the output of the warning sound.

Then, in an operation of returning, S180, the process of loss prevention returns to the operation of detecting a luminous intensity S110 to repeat the above-described operations when termination is not selected after the operation of deactivating the warning, S170 or when termination is not selected when the portable terminal is determined to be in a calling state in the operation of activating the warning, S150.

As described above, according to the present invention, for example, while the user is sitting in subway and the portable terminal slips out of his or her pocket, the apparatus detecting the luminous intensity of the portable terminal outputs the warning sound when the current luminous intensity becomes higher than a previous luminous intensity (the reference luminous intensity), indicating the potential loss, thereby preventing the loss of the portable terminal in advance.

According to the present invention as set forth above, an apparatus for preventing the loss of a portable terminal such as a mobile phone outputs a warning sound notifying the loss of the portable terminal in accordance with a luminous intensity, the degree of exposure to light, irrespective of a surrounding magnetic change, before the actual loss occurs, thereby effectively preventing the loss of the portable terminal in advance.

While the present invention has been shown and described in connection with the exemplary embodiments, it will be apparent to those skilled in the art that modifications and variations may be made without departing from the spirit and scope of the invention as defined by the appended claims.

What is claimed is:

1. An apparatus for preventing a loss of a portable terminal, the apparatus comprising:

a luminous intensity sensor unit for detecting a current luminous intensity level;

a main controller unit configured for comparing the current luminous intensity with a reference luminous intensity, for substituting the reference luminous intensity with the current luminous intensity when the current luminous intensity is lower than the reference luminous intensity, for determining whether the portable terminal is in a calling state when the current luminous intensity is higher than the reference luminous intensity, for controlling a request for an input of a password, for controlling an output of a warning sound when the current luminous intensity is higher than a reference luminous intensity and the portable terminal is not in the calling state, and for controlling stopping of the output of the warning sound when the password inputted matches a predetermined password;

a display unit for outputting a screen requesting the password and for outputting other screens related to a process of loss prevention according to the controlling of the main controller unit;

a key input unit for inputting the password and keys in accordance with the request from the main controller unit;

a memory unit in which the current luminous intensity detected by the luminous intensity sensor unit and the reference luminous intensity are saved; and a warning device for generating and outputting the warning sound in accordance with the controlling of the main controller unit.

2. The apparatus of claim 1, wherein the main controller unit is configured to set the reference luminous intensity to the current luminous intensity detected by the luminous intensity sensor unit immediately after the process of loss prevention begins, and save the reference luminous intensity in the memory unit.

3. The apparatus of claim 1, wherein the luminous intensity sensor unit comprises:

a luminous intensity sensor for detecting a current luminous intensity; and a sub-controller for monitoring the current luminous intensity detected by the luminous intensity sensor, for determining whether or not the current luminous intensity is higher than the reference luminous intensity, and for transmitting a result of comparison to the main controller unit.

4. The apparatus of claim 3, wherein the sub-controller is configured to set the luminous intensity, detected by the luminous intensity sensor immediately after the process of loss prevention begins, as the reference luminous intensity and saves the reference luminous intensity in the memory unit.

5. The apparatus of claim 4, wherein the sub-controller is configured to substitute the reference luminous intensity with the current luminous intensity when the current luminous intensity detected by the luminous intensity sensor is lower than the reference luminous intensity after the process of loss prevention begins.

6. The apparatus of claim 1, wherein the luminous intensity sensor unit includes a luminous intensity sensor for detecting a current luminous intensity and a door installed on an exterior portion of the portable terminal to cover or expose the luminous intensity sensor.

7. A method of preventing loss of a portable terminal, the method comprising:

detecting a current luminous intensity when a process of loss prevention begins and setting the detected current luminous intensity as a reference luminous intensity;

repeatedly detecting a current luminous intensity throughout the process of loss prevention;

comparing the current luminous intensity with the reference luminous intensity and substituting the reference luminous intensity with the current luminous intensity when the current luminous intensity is lower than the reference luminous intensity;

determining whether the portable terminal is in a calling state when the current luminous intensity is higher than the reference luminous intensity;

generating and outputting a warning sound when the current luminous intensity is higher than the reference luminous intensity;

requesting for an input of a password and determining whether the password inputted matches a predetermined password; and stopping an output of the warning sound when the password inputted matches the predetermined password.

8. The method of claim 7, further comprising returning to detecting a current luminous intensity when termination is not selected after the stopping an output of the warning sound or when termination is not selected after the portable terminal is determined to be in a calling state in the generating and outputting a warning sound.

9. The method of claim 7, further comprising exposing a luminous intensity sensor to an external environment.

* * * * *